US007984537B2

(12) United States Patent
Champaigne

(10) Patent No.: US 7,984,537 B2
(45) Date of Patent: Jul. 26, 2011

(54) METHOD OF SHOT PEENING COIL SPRINGS

(75) Inventor: Jack Champaigne, Mishawaka, IN (US)

(73) Assignee: Electronics Inc., Mishawaka, IN (US)

( * ) Notice: Subject to any disclaimer, the term of this patent is extended or adjusted under 35 U.S.C. 154(b) by 1181 days.

(21) Appl. No.: 11/680,852

(22) Filed: Mar. 1, 2007

(65) Prior Publication Data

US 2008/0209731 A1 Sep. 4, 2008

(51) Int. Cl.
*B21C 37/30* (2006.01)

(52) U.S. Cl. ..... 29/90.7; 29/90.01; 72/53

(58) Field of Classification Search ..... 29/90.7, 29/90.01; 72/53

See application file for complete search history.

(56) References Cited

U.S. PATENT DOCUMENTS 5,265,857 A * 11/1993 Chiang ..... 271/10.13

FOREIGN PATENT DOCUMENTS

JP 60174230 A * 9/1985
JP 61027135 A * 2/1986
JP 08224632 A * 9/1996
JP 2002361558 A * 12/2002

* cited by examiner

*Primary Examiner* — Sarang Afzali
(74) *Attorney, Agent, or Firm* — Botkin & Hall, LLP

(57) ABSTRACT

Both the inner and outer circumferential surfaces of a coil spring are peened by passing sequential segments of the spring around offset pulleys mounted within a peening cabinet. As the spring is pulled around one of the pulleys, the coils fan out from the pulley to permit the peening media to impact portions of the inner and outer circumferential surfaces of the spring, and as the spring is pulled around the other pulley, the portions of the surfaces not peened as the segment traveled around the first pulley will be peened.

3 Claims, 2 Drawing Sheets

METHOD OF SHOT PEENING COIL SPRINGS

BACKGROUND OF THE INVENTION

1. Field of the Invention

This invention relates to a method of shot peening coil springs.

2. Description of the Background of the Invention

Shot peening is a well known and widely accepted technique for increasing strength of metal components. Coil springs are often repeatedly stressed during use and benefit from shot peening. Accordingly, it is desirable to shot peen springs to increase strength. Tests have shown that, while failure can occur anywhere on the spring, failures are more common on the inside of the spring making it desirable to peen both the inner and outer diameters of coiled springs. Most compression springs are normally "open" in there relaxed state so that there is a gap between the coils that is large enough to permit peening by conventional methods. Accordingly, peening of the inner diameter of a compression coil spring may be easily accomplished, except for compression springs having very small gaps between the coils that prevent peening of the inner diameter of the spring by conventional methods. Coils of extension springs normally engage one another, permitting peening only on the outer diameter unless the spring is stretched to open passages between the coils. This is not difficult for relatively short springs, which may be stretched within the peening cabinet, but it limits the length of springs that can be peened to the size of the peening cabinet. Other prior art methods for peening the inner diameter of coil springs include inserting a lance into the spring, but again, only relatively short springs may be peened in this manner. In all cases, since the size of peening cabinets is limited, the length of extension springs that may be peened is also limited.

SUMMARY OF THE INVENTION

This invention relates to a method of shot peening a coil extension spring having coils normally sufficiently close to one another when the spring is relaxed so that the inner diameter of the spring may not receive the intended peening treatment. Such springs include extension coil springs and compression coil springs in which the space between the coils is small. The method includes the steps of wrapping a portion of the spring around offset pulleys rotatably mounted within a peening cabinet and pulling the spring through the peening cabinet while directing shot peening media onto the outer surface of the spring. Although pulleys are illustrated, any arcuate surface (whether or not rotatable; for example, a rod) may be used. By forcing the spring around the pulleys, one side of the spring remains in contact with the pulleys, so that the coils fan out from one another, thereby opening up the spring to peening of a portion of the inner diameter of the spring. The sides of the coils contacting the pulleys remain sufficiently close to one another such that a relatively small amount of the peening media can travel all of the way through the spring, so that the surfaces of the pulleys are protected from the peening media. As the spring travels around a subsequent offset pulley, the portion of the spring that was fanned out is engaged with the subsequent pulley and the portion of the spring that was engaged with the first pulley is fanned out, thereby permitting media to complete the peening of the outer and inner surfaces of the spring. The pulleys may be rotated by an external power source to move the spring through the cabinet. Alternatively, the spring may be pulled through the cabinet. Since the spring extends through the cabinet, the spring can be of indeterminate length, so that very large extension springs may be peened in this manner.

DETAILED DESCRIPTION OF INVENTION

Figure 1:
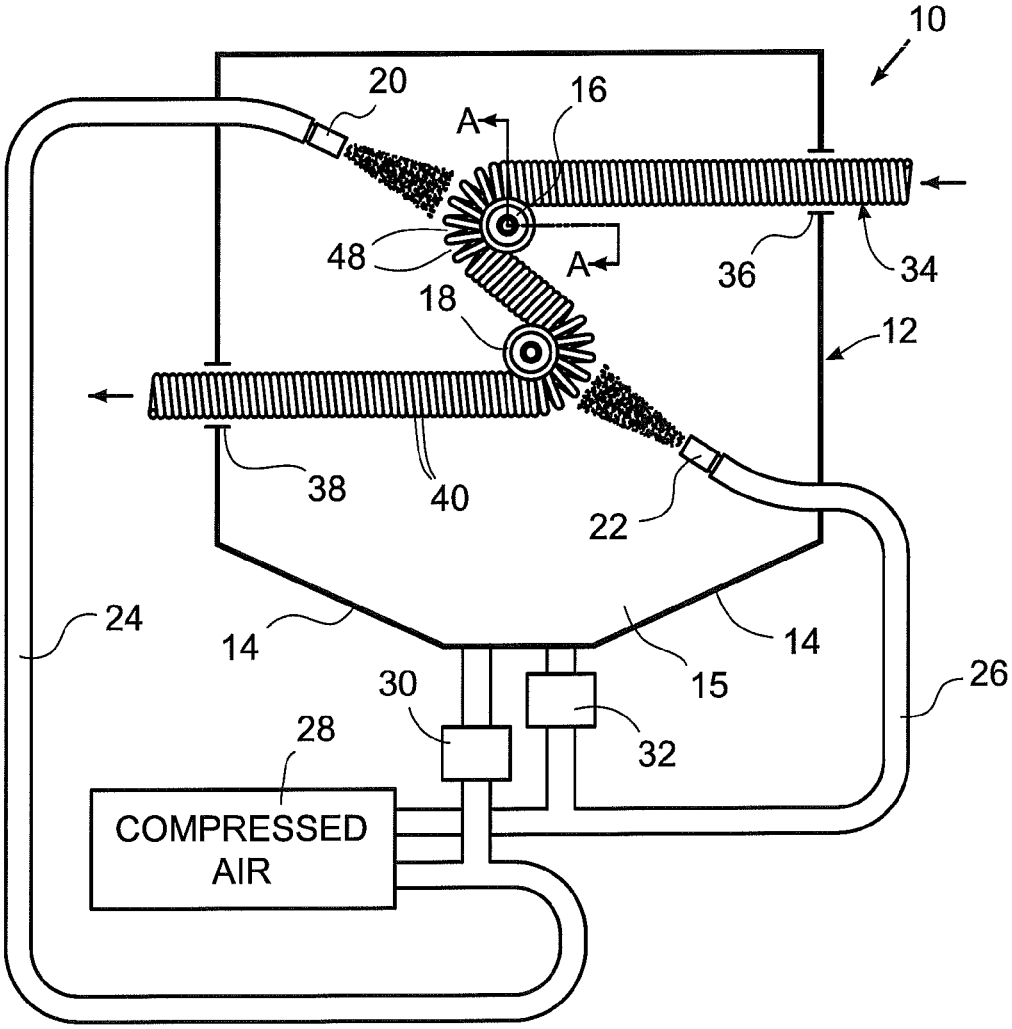
FIG. 1 is a diagrammatic illustration of a peening apparatus used to practice the method of the present invention.
Figure 2:
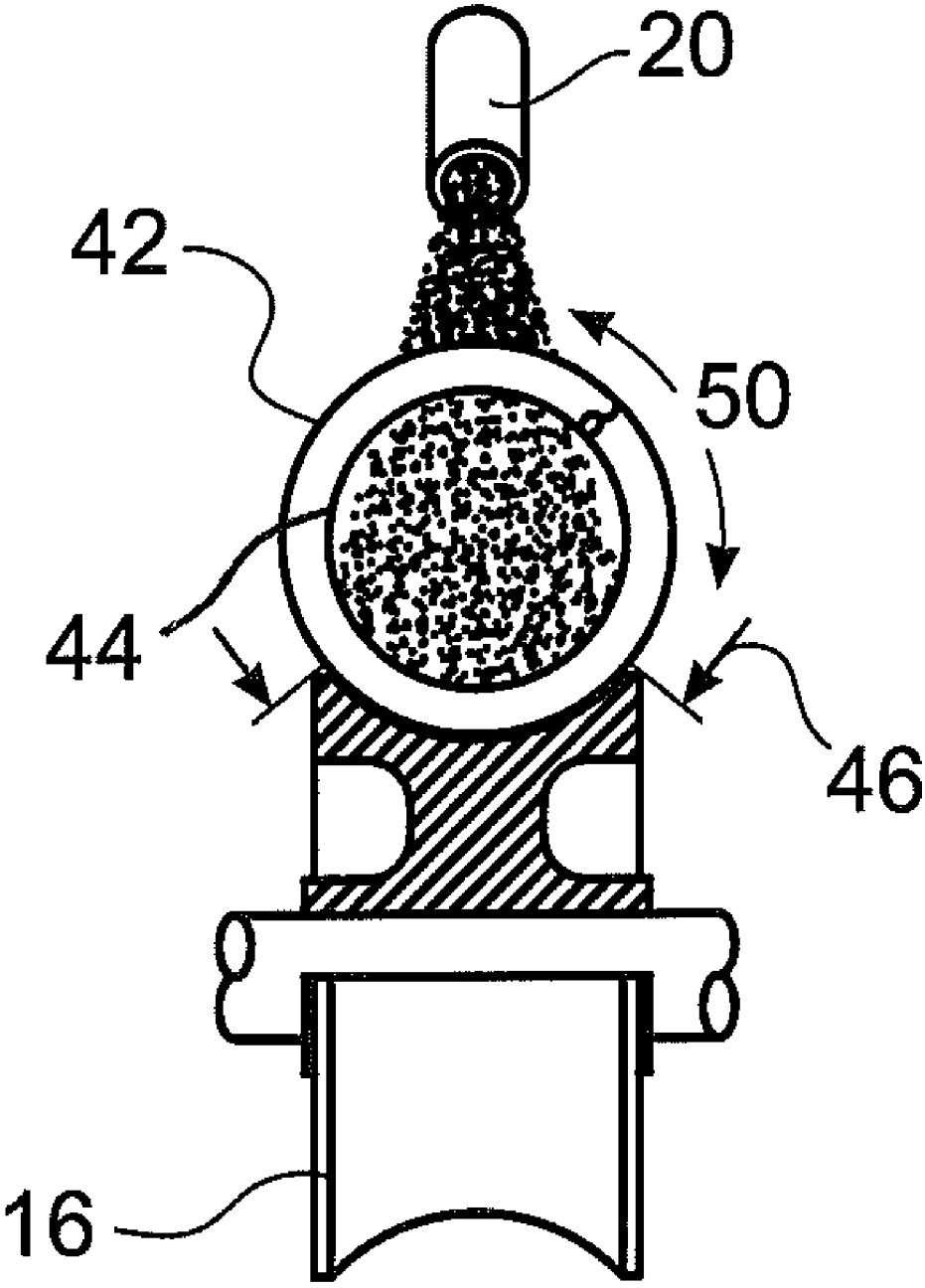
FIG. 2 is an enlarged, cross-sectional view taken substantially along lines A-A of FIG. 1.

Referring now to the drawings, a peening apparatus 10 includes a peening cabinet generally indicated by the numeral 12. The peening cabinet 12 is conventional and is designed so that the lower portion of the cabinet is defined by tapered sides 14, which define a hopper 15 which holds the peening media or shot. A pair of rotatable pulleys 16, 18 is rotatably mounted within the peening cabinet 10. As can be seen in the drawings, the pulleys 16, 18 are offset from one another. The peening apparatus 10 further includes a pair of peening nozzles 20, 22 of conventional design which are mounted within the cabinet 10 and are directed to a portion of the outer circumferential surface of the pulleys 16, 18 respectably. Additional pulleys and peening nozzles may be used if necessary. Each of the peening nozzles 20, 22 is fed by one of conventional blast hoses 24, 26, both of which are connected to a source of compressed air 28. Shot stored in the hopper 15 is dispensed into the blast hoses 24, 26 through conventional flow regulating mechanisms 30, 32, which control the rate at which shot is fed from hopper 15 into the blast hoses 24, 26.

An elongated coil spring generally indicated by 34 is fed into the peening cabinet 10 through an opening 36 and is threaded around the offset pulleys 16, 18 as shown in the drawings. The spring 34 exits the peening chamber 10 through opening 36. It will be appreciated that since the spring 34 includes a portion within the peening cabinet 12 as well as portions that have not entered the peening cabinet 12 and have exited the peening cabinet 12, the spring 34 can be of any desired length, so that the method of the present invention is not limited to springs small enough to fit within the peening cabinet 12 with their coils spread apart. Since the nozzles 20, 22 are not directed toward the openings 36, 38, the peening media is confined within the cabinet 12.

The spring 34 is defined by multiple coils 40. If the spring 34 is an extension spring, the coils 40 generally engage one another when the spring 34 is relaxed; if the spring 34 is a compression spring, the coils may be relatively close to one another when the spring 34 is relaxed. When the spring 34 is extended, the bias of the spring 34 urges the coils 40 back into engagement with one another in the case of an extension spring or back to the initial spacing if the spring is a compression spring. The coils 40 of the spring 34 cooperate to define an outer circumferential surface 42 of the spring 34 and an inner circumferential surface 44. Referring to the portion of the spring 34 which is wrapped around the pulley 16, it will be noted that a circumferentially extending section defined by an arc 46 of the outer circumferential surface 42 of the spring 34 engages the outer circumferential surface of the pulley 16 so that the coils 40 fan out from the section 46 to create gaps 48 between the coils 40 in the circumferentially extending section defined by an arc 50 of the spring 34 disposed radially outwardly from the section defined by the arc 46. Accordingly, the peening media discharged from the nozzle 20 peens a substantial portion (but not all) of the section defined by the arc 50 of the outer circumferential surface 42, and, because some of the peening media penetrates into the interior of the spring through the gaps 48, a section of the inner circumferential surface of the spring 34 will also be peened. The section of the inner circumferential surface 44 peened in this manner will be a section defined by the arc 46 of the outer circumferential surface 42, plus a portion of the inner circumferential surface 44 adjacent the arc 46. Since the section of the outer circumferential surface 42 of the coils defined by the arc 46 remain either engaged with another (or are separated by only a very small distance), the outer circumferential surface of the pulley 16 is protected from impact by the peening media, thus increasing the life of the pulley 16. As the spring 34 travels through the peening chamber 12, sequential portions of the spring 34 are passed over the pulley 16. The spring 34 may be pulled through the peening cabinet 12, but the spring 34 may also be forced through the peening cabinet 12 by powered rotation of the pulleys 16, 18.

As the spring is pulled through the cabinet 12, the segment of the spring 34 peened by the media discharged from the nozzle 20 as it travels around the pulley 16 subsequently travels over the pulley 18. As this occurs, the portion of the outer circumferential surface 42 opposite the section defined by the arc 46 will engage the pulley 18. Accordingly, section 46 that engaged the pulley 16 will now be extended to create gaps between the coils 40. In this way, the portion of the outer circumferential surface 42 of the spring 34 that was not peened as it traveled around the pulley 16 will be peened as it travels around the pulley 18; similarly, the portion of the inner circumferential surface 44 of the spring 34 that was shielded from direct impact of the media (although it may have received indirect impacts of the media) will be impacted by the media. Accordingly, as the spring 34 travels across the pulleys 16 and 18, the inner and outer surfaces of the spring 34 will be peened. Springs of indeterminate length may accordingly be peened, as the coils 40 of sequential sections of the spring 34 are spread to permit peening of the inner circumferential surface 44 of the spring 34.

What is claimed is:

1. Method of shot peening a coil spring having coils with an inner diameter and an outer diameter, said coils normally being sufficiently close to one another when the spring is relaxed that an inner surface of the spring defined by the inner diameter of said coils is substantially closed off from an outer surface of the spring defined by the outer diameter of said coils, said method including the steps of pulling said spring through a treatment chamber wrapping a portion of the spring around an arcuate surface on a pulley being rotatably mounted in said treatment chamber and longitudinally moving said spring relative to said pulley whereby sequential coils of said spring are moved around said arcuate surface so that said sequential coils are separated from one another along portions of said coils disposed radially outward from said arcuate surface of said pulley to create openings between the coils thereby expose at least a portion of the inner surface to a shot peening media applied externally of said spring, directing said media to the outer surface to effect peening of the outer surface, and permitting a portion of said media to pass through said openings to thereby effect peening of at least a portion of said inner surface.

2. Method of shot peening a coil spring having coils with an inner diameter and an outer diameter, said coils normally being sufficiently close to one another when the spring is relaxed that an inner surface of the spring defined by the inner diameter of said coils is substantially closed off from an outer surface of the spring defined by the outer diameter of said coils, said method including the steps of wrapping of a portion of the spring around a pair of pulleys rotatably mounted in a treatment chamber and offset from one another, said spring including an internal portion within the treatment chamber and external portions entering and exiting said chamber, said spring being passed through said chamber by pulling on the portion exiting the chamber, a first circumferentially extending section of said coils being passed across one of said pulleys and a second circumferentially extending section of said coils radially offset from said first section being fanned out from said first section to thereby create openings between coils of said spring exposing said first section to shot peening, and said second circumferentially extending section engaging said other pulley as the spring is passed across said other pulley and said first section being fanned out from said second section to expose said second section to shot peening as the spring passes over said other pulley, directing said shot peening media through a first nozzle mounted in said chamber adjacent said one pulley and offset from said openings created as the spring passes across said one pulley to the outer surface to effect peening of the outer surface as the spring passes across said one pulley, and permitting a portion of said media to pass through said openings to thereby effect peening of at least a portion of said inner surface and directing shot peening media through a second nozzle mounted in said chamber adjacent: said other pulley and offset from said openings created as the spring passes across said other pulley to effect peening of at least a portion of said inner surface.

3. Method of shot peening a coil spring having coils with an inner diameter and an outer diameter, said coils normally being sufficiently close to one another when the spring is relaxed that an inner surface of the spring defined by the inner diameter of said coils is substantially closed off from an outer surface of the spring :defined by the outer diameter of said coils, said method including the steps of wrapping of a portion of the spring around a pair of pulleys offset from one another, a first circumferentially extending section of said coils being passed across one of said pulleys engaging said one pulley and a second circumferentially extending section of said coils radially offset from said first section being fanned out from said first section to thereby create openings between coils of said spring exposing said first section to shot peening and said second circumferentially extending section engaging said other pulley as the spring is passed across said other pulley and said first section is fanned out from said second section to expose said second section to shot peening as the spring passes over said other pulley and thereby exposing the inner surface to shot peening media applied externally of said spring as the spring travels across said pulleys, directing said shot peening media to the outer surface to effect peening of the outer surface as the spring passes across each pulley, and permitting a portion of said media to pass through said openings to thereby effect peening of at least a portion of said inner surface, wherein the coils of said second section are maintained sufficiently close to one another when the first section is fanned out that shot peening media is substantially prevented from passing through the second section, and the coils of said first section are maintained sufficiently close to one another when the second section is fanned out that shot peening media is substantially prevented from passing through the first section.

* * * * *

UNITED STATES PATENT AND TRADEMARK OFFICE

CERTIFICATE OF CORRECTION

PATENT NO. : 7,984,537 B2
APPLICATION NO. : 11/680852
DATED : July 26, 2011
INVENTOR(S) : Jack Champaigne It is certified that error appears in the above-identified patent and that said Letters Patent is hereby corrected as shown below:

Col. 3, Claim 1, line 8, following the word “chamber” add -- and --.

Col. 4, Claim 2, line 32, following the word “adjacent”, delete “:”.

Col. 4, Claim 3, line 6, following the word “spring”, delete “:”.

Signed and Sealed this
Eighteenth Day of October, 2011

David J. Kappos

David J. Kappos
*Director of the United States Patent and Trademark Office*